United States Patent [19]

Jacalone

[11] 4,085,847

[45] Apr. 25, 1978

[54] PALLET BOX PACK

[75] Inventor: Richard P. Jacalone, Owosso, Mich.

[73] Assignee: Olinkraft, Inc., West Monroe, La.

[21] Appl. No.: 774,477

[22] Filed: Mar. 4, 1977

Related U.S. Application Data

[63] Continuation-in-part of Ser. No. 744,816, Nov. 24, 1976, abandoned.

[51] Int. Cl.[2] ..... B65D 19/20

[52] U.S. Cl. ..... 206/600; 108/51.3; 229/23 BT

[58] Field of Search ..... 206/600, 386, 596, 45.19; 108/51.3; 229/23 BT

[56] References Cited

U.S. PATENT DOCUMENTS

| | | | |
|---|---|---|---|
| 1,930,031 | 10/1933 | Andrews | 206/45.19 |
| 3,246,824 | 4/1966 | Gardner | 108/51.3 |
| 3,291,364 | 12/1966 | Fischer | 206/600 |
| 3,348,673 | 10/1967 | Bahls | 206/600 |
| 3,730,417 | 5/1973 | Lawson | 206/596 |
| 3,995,736 | 12/1976 | Lawson | 206/386 |

*Primary Examiner*—William Price

*Attorney, Agent, or Firm*—O'Brien and Marks

[57] ABSTRACT

A pallet box pack is disclosed which includes a pallet base and a top cover with a collapsed tube assembly having inwardly bendable bottom flanges and being received in the pallet base underneath the top cover. The pallet box pack can be converted to a bulk pallet box by erecting the collapsed tube assembly so that it forms a receptacle for bulk material.

11 Claims, 9 Drawing Figures

FIG. 4
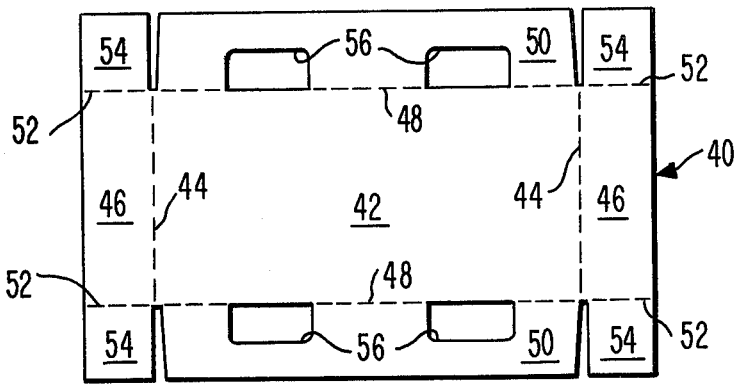
FIG. 3
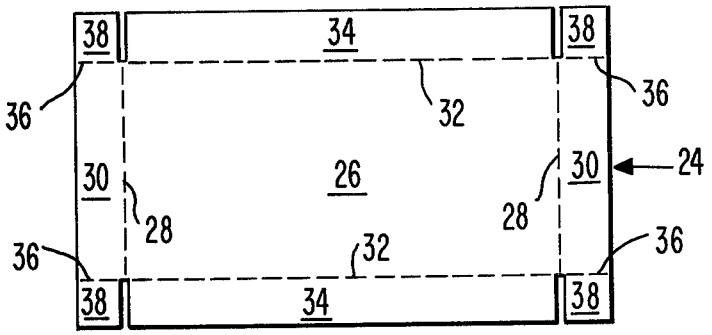
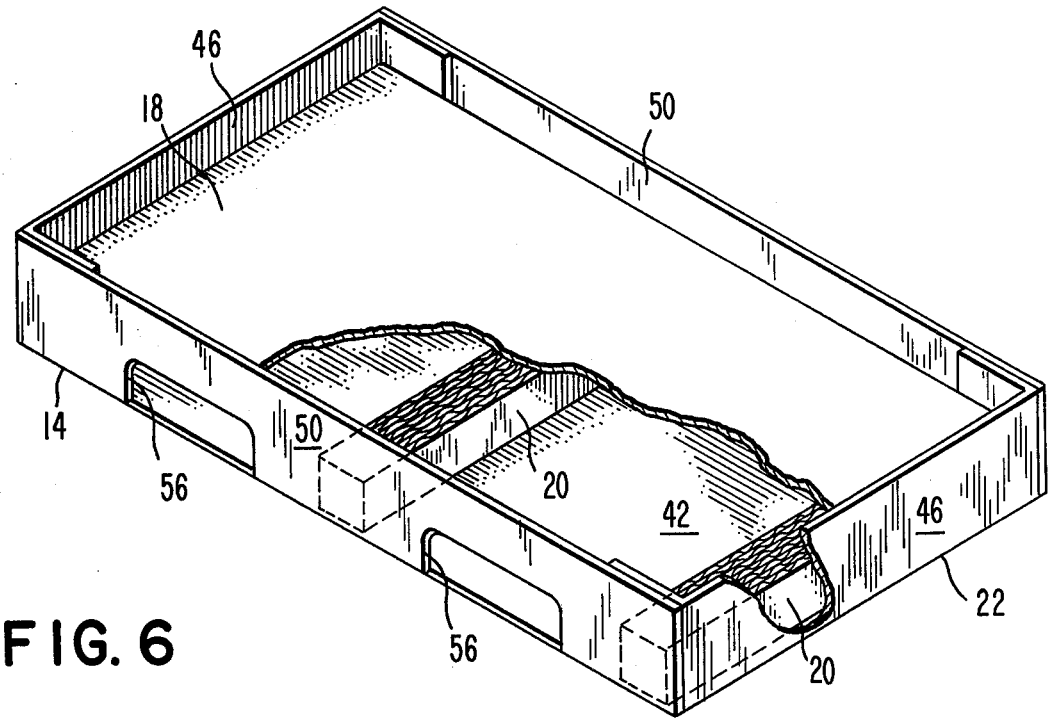
FIG. 6

PALLET BOX PACK

CROSS REFERENCE TO RELATED APPLICATION

This application is a continuation-in-part of copending patent application Ser. No. 744,816, filed Nov. 24, 1976 and now abandoned.

BACKGROUND OF THE INVENTION

1. Field of the Invention

The present invention relates to containers for the transport of bulk material, and more particularly, to such containers which are sold in kit or unassembled form for erection by the user at the site of use.

2. Description of the Prior Art

The prior art is generally cognizant of bulk containers having provisions for pallets therein. In at least one case, U.S. Pat. No. 3,337,036, a storage and shipping container including a provision for a pallet has been disclosed that is collapsible. A large portion of this container, however, is constructed of kraft paper alone thereby severely limiting the structural stability and load strength of the container. U.S. Pat. No. 3,743,166 describes a pallet container that has a knock-down feature for easy storage. U.S. Pat. No. 3,480,196, No. 3,502,237, No. 3,666,165 and No. 3,730,417 show other pallet containers and are cited to show further the state of the art in this area.

SUMMARY OF THE INVENTION

The present invention is summarized in that a pallet box pack includes a pallet base having a shallow tray defined on its top surface, a top cover fitting over the top of the pallet base, and a collapsed tube assembly with inwardly bendable bottom flanges received in the shallow tray of the pallet base underneath the top cover, the tube assembly being adapted to be erected to form the sides of a receptacle for bulk material.

It is an object of the present invention to provide a pallet box pack that is easily converted by a user into a bulk pallet box.

It is another object of the present invention to provide such a pallet box pack that can be constructed entirely from corrugated paperboard.

It is yet another object of the present invention to provide a bulk pallet box that can be erected from such a pallet box pack and that is sturdy, rigid and extremely strong.

Other objects, advantages and features of the present invention will become apparent from the following specification when taken in conjunction with the accompanying drawings.

BRIEF DESCRIPTION OF THE DRAWINGS

FIG. 3 is a plan view of a blank from which the top cover of the pallet box pack of FIG. 1 is constructed.

FIG. 4 is a plan view of a blank from which the base member of the pallet box pack of FIG. 1 is constructed.

FIG. 6 is a partially cut-away perspective view of the pallet base of the pallet box pack of FIG. 1.

DESCRIPTION OF THE PREFERRED EMBODIMENT

Figure 1:
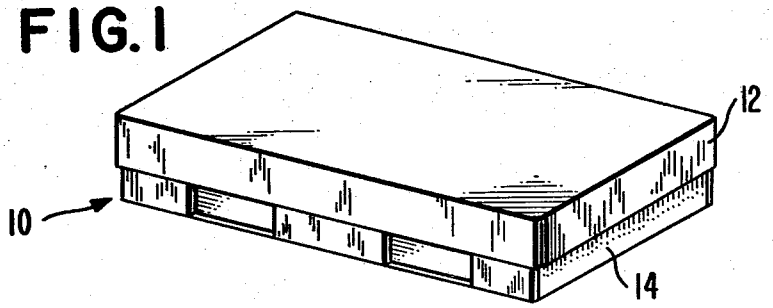
FIG. 1 is a perspective view of a pallet box pack constructed according to the present invention.

Shown in FIG. 1 is a self-storing pallet box pack, indicated generally at 10, constructed according to the present invention. The exterior of the pallet box pack 10 as shown in FIG. 1 is formed by a top cover 12 and a pallet base 14, the top cover 12 fitting over the pallet base 14. As can be seen best in the exploded view of FIG. 2, the pallet box pack 10 also includes a collapsed tube assembly 16 received between the top cover 12 and the pallet base 14. The pallet base 14 itself is formed from a load platform 18 and three pallet spacers 20, all of which are received in a tray-like base member 22. The details of the structure of each of these parts of the pallet box pack 10 will be described separately and in turn so as to make the structure and function of each part more readily apparent.

The details of the construction of the top cover 12 can be most easily understood by referring to FIG. 3, which shows, in reduced scale, a blank, generally indicated at 24, from which the top cover 12 is constructed. The blank 24, which is preferably formed of heavy-weight corrugated paperboard, has a generally rectangular top panel 26 centrally formed in it. The ends of the rectangle of the top panel 26 are defined by a pair of scorelines 28 each of which attaches a one of two top cover end flaps 30 to the opposite ends of the top panel 26. Similarly a pair of scorelines 32 define the sides of the rectangle of the top panel 26 and secure a pair of top cover side flaps 34 to opposite sides of the top panel 26. Each of the ends of both of the end flaps 30 are defined by a one of four scorelines 36 each of which secures a respective one of four corner flaps 38 to each of the ends of the end flaps 30.

In erecting the top cover 12 from the blank 24, the end flaps 30 are both first folded upward along the two scorelines 28 to a vertical position. Then the four corner flaps 38 are all folded inward along the scorelines 36 to positions perpendicular to the end flaps 30. Finally the side flaps 34 are both folded upward along the scorelines 32 to vertical positions and are either stapled or glued to the corner flaps 38 to secure the top cover 12 in its erected state.

To most completely understand the details of construction of the pallet base 14, it is necessary to consider first the construction of the base member 22, which is erected from a blank, generally indicated at 40, shown in FIG. 4. Centrally formed in the blank 40, which is also preferably formed of heavy-duty corrugated paperboard, is a generally rectangular bottom panel 42. The opposite ends of the rectangle of the bottom panel 42 are formed by a pair of scorelines 44 each of which secures a one of two base member end flaps 46 to the opposite ends of the bottom panel 42. The sides of the rectangle of the bottom panel 42 are in turn defined by a pair of scorelines 48 which attach a pair of base member side flaps 50 to the opposite sides of the bottom panel 42. The ends of each of the end flaps 46 are formed by scorelines 52 each of which joins a one of four corner flaps 54 to an end of one of the end flaps 46.

Formed by die-cuts in each of the side flaps 50 are a pair of lift arm holes 56, which are elongate generally rectangular cut-outs having their long axes aligned parallel to the scorelines 48 and with each having a one of its long sides formed along the adjacent scoreline 48. The two lift arm holes 56 on each of the side flaps 50 are spaced from each other a distance equal to the spacing of the lift arms of a conventional fork lift truck, and the two lift arm holes 56 on each of the side flaps 50 are positioned thereon so to be aligned with the lift arm holes 56 on the opposite side flap 50. All of the end flaps 46 and the side flaps 50 of the blank 40 are formed so as to be significantly wider than the end flaps 30 and side flaps 34 of the blank 24 for reasons which will become apparent below.

The erection of the base member 22 from the blank 40 begins with the folding upward to vertical positions of the end flaps 46 along scorelines 44. The corner flaps 54 are all then folded inward along the scorelines 52 to positions perpendicular to the end flaps 46. At that time the side flaps 50 would then be folded upward along the scorelines 48 also to vertical positions and the corner flaps 54 would be secured by gluing or stapling to the ends of the side flaps 50 to secure the completed base member 22 in position.

The completed pallet base 14 also includes the load platform 18 and the three pallet support spacers 20. The load platform 18 is a rectangular, rigid, planar member preferably formed from heavy corrugated paperboard. The pallet spacers 20 are solid, elongated bars of rigid material, and are preferably formed by several layers of stiff corrugated paperboard bonded together. The load platform 18 is sized so as to be of generally the same size as the bottom panel 42 of the blank 40 while the pallet spacers 20 are sized so as to be approximately as long in length as the width of the bottom panel 42 of the blank 40 and to be significantly smaller in height than the width of the end flaps 46 and the side flaps 50 of the blank 40 for reasons that will become apparent. While, as stated, it is preferred that the load platform 18 and the pallet spacers 20 be fabricated entirely of paperboard, it may be advantageous in particular applications to construct these parts of other materials, such as wood, metal, or plastic, without departing from the spirit of the present invention.

Figure 5:
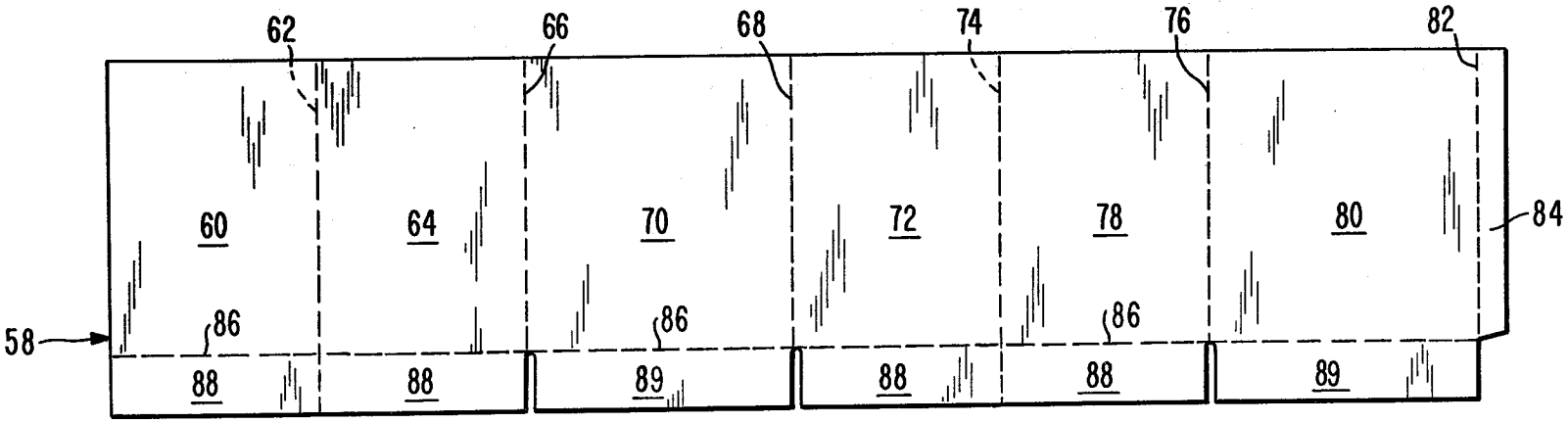
FIG. 5 is a plan view of a blank from which the tube assembly of the pallet box pack of FIG. 1 is constructed.

The details of construction of the tube assembly 16 can best be understood by referring to FIG. 5 which shows a blank, generally indicated at 58, from which the tube assembly 16 is formed. The blank 58, which is also preferably fabricated from corrugated paperboard, will for the purpose of this description be assumed to have an exterior face and an interior face, with the interior face of the blank 58 being shown in FIG. 5. Formed at one end of the blank 58 is a half side panel 60 which has one of its edges defined by the end of the blank 58 and the other of its side edges formed by a reverse scoreline 62. A half side panel 64 has one of its side edges formed by the reverse scoreline 62 and the other of its side edges defined by a scoreline 66. A scoreline 68 is formed in the blank 58 with an end wall panel 70 being defined between the scorelines 66 and 68. A half side panel 72 is formed between the scoreline 68 and a reverse scoreline 74. Another scoreline 76 formed in the blank 58 defines another half side panel 78 between it and the reverse scoreline 74. An end wall panel 80 is formed between a scoreline 82 in the blank 58 and the scoreline 76. A tab flap 84 is secured to the end panel 80 by the scoreline 82. All of the scorelines 62, 66, 68, 74, 76, and 82 are preferably parallel so that the panels 60, 64, 70, 72, 78 and 80 are generally rectangular with their side edges defined as described above, all their top edges defined by the edge of the blank 58, and all their bottom edges defined by a common scoreline 86. The common scoreline 86 secures a respective one of four bottom flanges 88 and 89 to each pair of the half side panels 60, 64, 72, and 78 and the end wall panels 70 and 80 with the bottom flanges 88 extending substantially the full length of the respective pairs of half side panels 60, 64, 72, and 78 and with the bottom flanges 89 extending substantially the full length of the respective end wall panels 70 and 80. The half side panels 60 and 64 form one whole side wall panel, and similarly the half side panels 72 and 78 together form another whole side wall panel. Thus each of the reverse scorelines 62 and 74 are formed intermediately in a respective side wall panel of the blank 58. The reverse score lines 62 and 74 also extend across the flanges 88 to form pairs of half flanges. The reverse scorelines 62 and 74 are termed "reverse" inasmuch as they are formed so as to fold in the opposite direction from the other scorelines in the blank 58. Thus the scorelines 66, 68, 76 and 82 are formed so that the parts of the blank 58 adjacent each of those scorelines tend to fold together toward the interior face of the blank 58 while the reverse scorelines 62 and 74 are formed so that the pairs of half side panels 60 and 64 and 72 and 78 and pairs of half flanges 88 fold toward each other in the direction of the exterior face of the blank 58. One possible way of accomplishing this is by forming the scorelines 66, 68, 76, and 82 on one face of the blank 58 and by forming the reverse scorelines 62 and 74 on the other face.

In forming the tube assembly 16 from the blank 58, the end of the blank 58 is first folded inwardly along the scoreline 76 so that the end panel 80 is brought over onto the half side panels 72 and 78. Then the other end of the blank 58 is folded along the scoreline 66 so that the end half side panels 60 and 64 are folded inwardly over onto the end panel 70 and the half side panel 72. The edge of the half side panel 60 is then secured to the tab flap 84 by suitable gluing, stapling or stitching. Pressure on the scorelines 66 and 76 then erects the blank 58 by folding it along the scorelines 68 and 82 to form the erected tube assembly 16. To collapse the tube assembly 16 thus formed to its configuration as shown in FIG. 2, the reverse scorelines 62 and 74 are then pushed inwardly into the interior of the enclosure, thus folding the pairs of the half side panels 60 and 64, and 72 and 78 and pairs of half flanges 88 toward each other and toward the exterior face of the blank to collapse the tube assembly 16 to its collapsed position as shown.

The assembly of the completed pallet box pack 10 from its component parts begins with the assembly of the pallet base 14. In the first step in assembling the pallet base 14, the pallet spacers 20 are mounted inside the base member 22. This mounting is preferably accomplished by the gluing of each of the three pallet spacers 20 across the width of the bottom panel 42 of the base member 22, the pallet spacers 20 being positioned with one at each end of the bottom panel 42 and one in the middle thereof. The load platform 18 is then lowered into the base member 22 and attached securely to the pallet spacers 20, preferably by gluing. By attaching the pallet spacers 20 in this manner, there is eliminated any potential problem of loosening or mutilation of the spacers as could occur if they were mounted on the exterior of the container. The completed pallet base 14 thus formed is shown in FIG. 6. Note that a shallow tray is formed on the top surface of the pallet base 14 by the load platform 18 and the portions of the side flaps 50 and end flaps 46 of the base member 22. The formation of this shallow tray is the reason that the pallet spacers 20 were sized so as to be smaller in height than the width of the side flaps 50 and the end flaps 46 of the blank 40. Thus the shallow tray thus formed on the pallet base 14 is merely a flat surface, formed by the load platform 18, and a raised lip surrounding that flat surface, with the raised lip being formed in this instance by the extreme portions of the end flaps 46 and the side flaps 50 which extend above the load platform 18. Note also that the lift arm holes 56, because they are all formed with a one of their edges formed along the scorelines 48, are located at the bottom edge of the pallet base 14 so that fork lift truck lift arms which enter the lift arm holes 56 are underneath the load platform 18. The pallet spacers 20 are spaced as they are so as to most evenly distribute any weight on the load platform 18 without blocking any of the lift holes 56.

Figure 2:
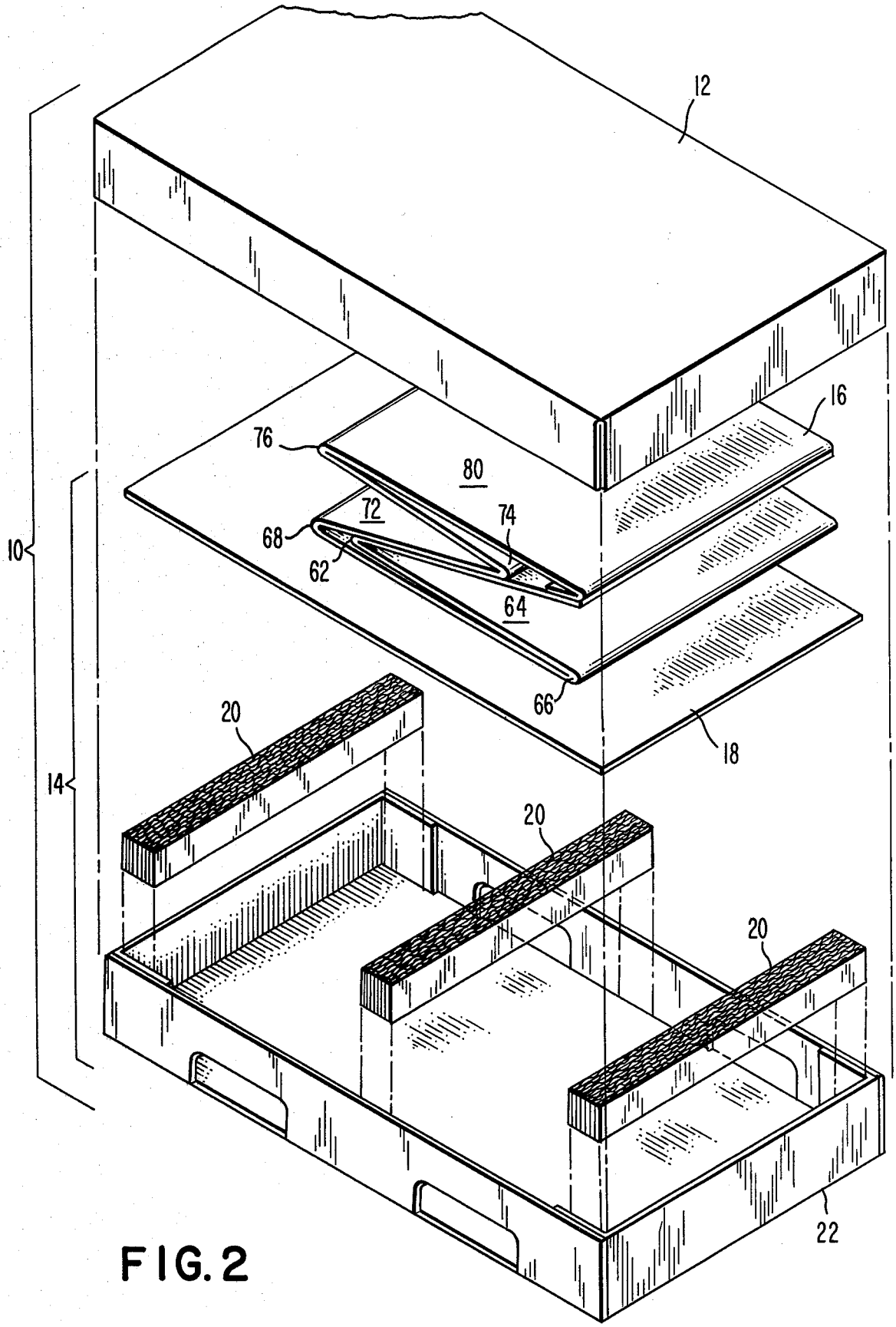
FIG. 2 is an exploded perspective view of the pallet box pack of FIG. 1.

To complete the pallet box pack 10, the tube assembly 16, in its collapsed configuration as shown in FIG. 2, is placed inside the shallow tray on the top of the pallet base 14 and the top cover 12 is then placed over the top of the pallet base 14 to complete the pallet box pack 10 shown in FIG. 1. Note that since the side flaps 34 and end flaps 30 of the blank 24 are narrower than the side flaps 50 and end flaps 46 of the blank 40, when the top cover 12 fits over the pallet base 14 the lift holes 56 are still accessible so that the pallet box pack 10 can still be easily handled, alone or in stacks.

Figure 7:
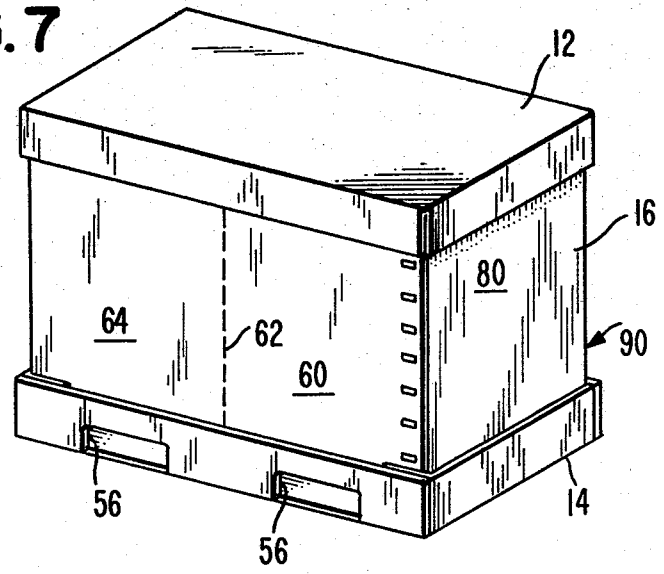
FIG. 7 is a perspective view of a bulk pallet box erected from the pallet box pack of FIG. 1.

The pallet box pack 10 can be shipped in the configuration of FIG. 1 to its potential users. In this configuration, the pallet box pack 10 is, in essence, a kit from which a bulk pallet box may be erected. At the site of the use, the kit of the pallet pack 10 of FIG. 1 is then erected into a completed bulk pallet box, generally indicated at 90 in FIG. 7. The bulk pallet box 90 of FIG. 7 could be used in this configuration as a volume container for shipments of large quantities of bulk material or parts. After use, the bulk pallet box 90 of FIG. 7 could be collapsed and re-assembled back into the pallet box pack 10 of FIG. 1 for shipment back to the site of origin of the goods for reloading and reshipment. In this way a single bulk pallet box 90 can be continuously reused and re-cycled with a minimum of waste. The compactness of the pallet box pack 10 of FIG. 1 encourages re-use of the box since the pallet box pack 10 is compact and relatively easy to handle, store and transport. Alternatively the bulk pallet box 90 could also be disposed of at its destination since the entire container can be fabricated from inexpensive corrugated paperboard. In either event the pallet box pack 10 is relatively simple and easy to erect at the site of use and requires no tools in its erection into the bulk pallet box 90.

To erect the bulk pallet box 90 from the pallet box pack 10, the top cover 12 is removed and the tube assembly 16 is removed from the shallow tray of the pallet base 14 and erected. The tube assembly 16 is erected by pressing outward on the reverse scorelines 62 and 74 to return the tube assembly 16 to a configuration where the whole side wall panels of the tube assembly are again straight to form a rectangular enclosure. The bottom flanges 88 and 89 are then all folded along the common scoreline 86 into the interior of the enclosure and the entire erected tube assembly 16 is set with its bottom inside the shallow tray of the pallet base 14 and with the bottom flanges extending over the platform 18. The shallow tray formed by the pallet base 14 serves as a form into which to erect the tube assembly 16 so that it may be filled with the bulk material. The bottom flanges 88 and 89 are provided in the bottom of the receptacle thus formed for two purposes, first to add strength to the tube assembly 16, and secondly to prevent any downward slippage of the tube assembly 16 relative to the pallet base 14. When the receptacle thus formed is filled, the top cover 12 is placed on top of the tube assembly 16 to complete the bulk pallet box 90 of FIG. 7. The bulk pallet box 90 can be transported by a fork lift truck which can insert its lift arms into the lift arm holes 56. The upward lift of the fork lift arms is transferred by the load platform 18 directly to the bulk material in the container to minimize stresses and loads on the bottom of the box. Any outward pressure on the sides of the container caused by the bulk material is transferred by the sides of the tube assembly 16 to the edges of the shallow tray of the pallet base 14. In this way a sturdy and economical pallet container is formed that is collapsible for easy empty shipment, is very economical and is extremely sturdy in its erected and filled condition.

If desired, the entire unit can be steel banded for shipment after loading. The steel bands can easily be guided through the fork hole openings, thus securing the complete unit together.

Figure 8:
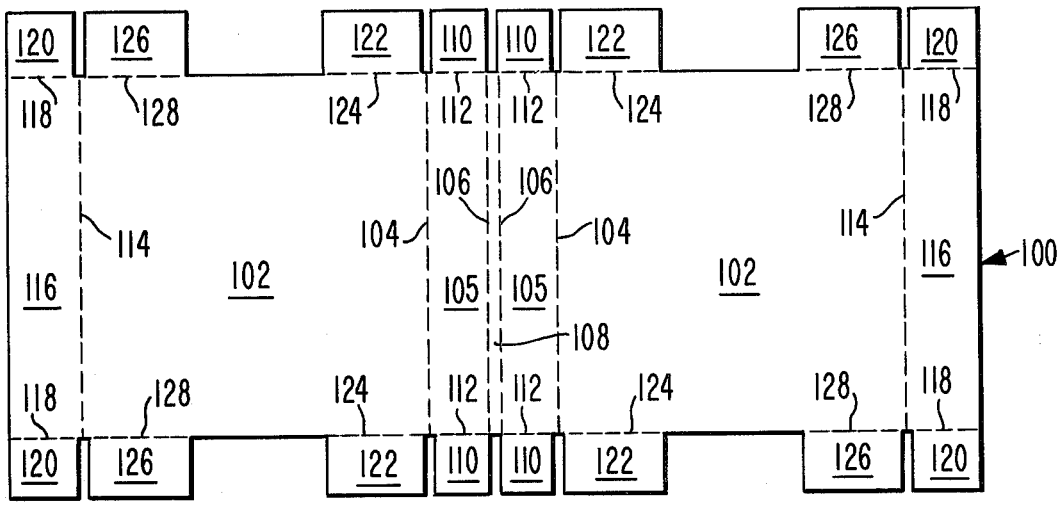
FIG. 8 is a plan view of a blank from which an alternate embodiment of the base member of the pallet base of FIG. 6 is constructed.

Shown in FIG. 8 is a blank, generally indicated at 100, which can be used together with the base member 22 to form an alternative embodiment of the pallet base 14, the blank 100 forming a load support replacing the load platform 18 and the pallet spacers 20. Centrally formed in opposite halves of the blank 100 are symmetrical load panels 102. Each of the load panels 102 has its edge closest the other load panel formed by a scoreline 104 which connects the load panel 102 to a respective one of two center support spacer panels 105. The opposite edges of the support panels 105 are in turn defined by scorelines 106 both of which form an edge of a support strip 108. A pair of support panel flaps 110 are attached by scorelines 112 to the opposite ends of each of the support panels 105. The edge of each of the load panels 102 opposite the respective scoreline 104 is defined by a one of respective scorelines 114 which secure respective end support spacer flaps or panels 116 to the outside edges of the load panels 102. At each end of each of the end flaps 116 there is a corner flap 120 secured to the end flap 116 by a scoreline 118. Along both sides of each of the load panels 102 adjacent the scorelines 104, a one of four outside support spacer flaps or panels 122 is secured to the respective load panel 102 by a scoreline 124. Similarly along both sides of each of the load panels 102 adjacent the scorelines 114, a one of four inside support spacer flaps or panels 126 is attached to the respective load panel 102 by a scoreline 128.

Figure 9:
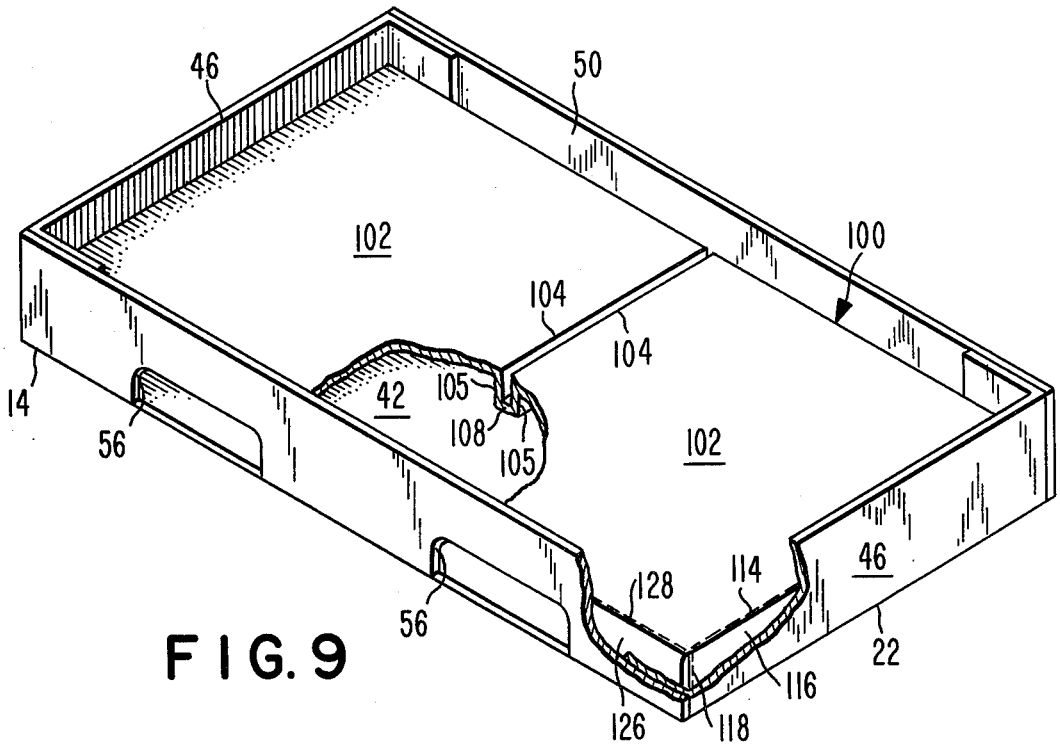
FIG. 9 is a partially cut-away perspective view of the alternate embodiment of the pallet base of FIG. 6.

In forming the blank 100 into a load support, the load panels 102 are first brought together by folding the support strip 108 downward. As viewed in FIG. 8, the support panels 105 are folded downward along the scorelines 104, thus bringing the scorelines 104 closer to each other. The support strip 108 meanwhile is folded by this action along the scorelines 106 so that the support strip 108 ends up in a horizontal orientation while the support panels 105 are vertical, as can be seen in FIG. 9. Then the end flaps 116 are both folded downward along the scorelines 114 to also be perpendicular to the support panels 102. Following that, all the support panel flaps 110 and all the corner flaps 120 are folded along the appropriate scorelines 112 and 118 underneath the adjacent support panel 102. The spacer flaps 122 and 126 are then folded downward along the scorelines 124 and 128, and the load support 100 is inserted inside the base member 22 to form the pallet base 14 as shown in FIG. 9. The corner flaps 120 and support panel flaps 110 support the load panels 102 and are secured in place by the spacer flaps 122 and 126 whch are in turn restrained by the sides of the base member 22. The gap between the spacer flaps 122 and 126 on each side of each of the load panels 102 is spaced so as to align with the lift arm holes 56 to receive fork lift arms therethrough. Additional structural security in the center of the pallet base 14 is provided by the support panels 105 and support strip 108 which are all fixed in place by the tucking of the support panel flaps 110 under the load panels 102 and inside the spacer flaps 122. The shallow tray is in this case formed by the two load panels 102 and all the parts of the base member 22 which project above it.

Inasmuch as many modifications, variations, and changes in detail are possible within the scope of the present invention, it is intended that all the material in the foregoing specification or in the accompanying drawings be interpreted as illustrative and not in a limiting sense.

What is claimed is:

1. A pallet box pack comprising a pallet base including a base member, load carrying means, and supporting spacer means;

said base member having a rectangular bottom panel, a pair of end flaps extending upward from respective opposite ends of the bottom panel, and a pair of side flaps extending upward from respective opposite sides of the bottom panel;

said pair of side flaps of the base member each having lift arm holes formed therein adjacent the bottom panel for receiving lift arms of a fork lift truck;

said supporting spacer means supporting said load carrying means above the bottom panel within the base member and forming passage means through the pallet base for receiving lift arms of a fork lift truck;

said flaps of the base member having upper portions extending above the load carrying means to form a shallow tray defined by the load carrying means and the upper portions of the flaps of the base member in the top of the pallet base;

a top cover fitting over the pallet base;

a collapsed tube assembly received in the shallow tray of the pallet base underneath the top cover;

said tube assembly including a pair of side wall panels, a pair of end wall panels, and four bottom flanges hinged at a common scoreline to bottom edges of the respective tube wall panels;

said tube side wall panels being connected between the opposite edges of the tube end wall panels at score lines;

said tube side wall panels further having respective reverse scorelines dividing each side wall panel into a pair of half side wall panels folded between the end wall panels;

said bottom flanges on the bottom edges of the tube side wall panels extending substantially the full lengths of the side wall panels;

said bottom flanges on the bottom edges of the tube side wall panels further having the reverse scorelines extending thereacross and being folded with the tube side wall panels; and said tube assembly being adapted to be erected to form with the pallet base and the top cover a receptacle for bulk material.

2. A pallet box pack as claimed in claim 1 wherein the top cover also has side flaps and end flaps and wherein the side flaps and the end flaps of the pallet base are wider than the side flaps and the end flaps of the top cover so that the lift arm holes in the pallet base are always exposed.

3. A pallet box pack as claimed in claim 1 wherein the supporting spacer means includes a plurality of pallet spacers, and the load carrying means includes a load platform, the pallet spacers and the load platform being received in the base member.

4. A pallet box pack as claimed in claim 1 wherein the pallet box pack is constructed entirely from corrugated paperboard.

5. A pallet box pack as claimed in claim 1 wherein the pallet base includes a load support having a pair of load panels and a plurality of support spacer panels, said load panels forming said load carrying means, said support spacer panels being folded relative to the load panels and forming said supporting spacer means, the load support being received in the base member such that the support spacer panels support the load panels in a raised position inside the base member.

6. A pallet box pack as claimed in claim 15 wherein the load panels are joined by a pair of center support spacer panels, the center support spacer panels being downfolded to provide further support for the load panels.

7. A bulk pallet box comprising a pallet base including a base member, load carrying means, and supporting spacer means;

said base member having a rectangular bottom panel, a pair of end flaps extending upward from respective opposite ends of the bottom panel, and a pair of side flaps extending upward from respective opposite sides of the bottom panel;

said pair of side flaps of the base member each having lift arm holes formed therein adjacent the bottom panel for receiving lift arms of a fork lift truck;

said supporting spacer means supporting said load carrying means above the bottom panel within the base member and forming passage means through the pallet base for receiving lift arms of a fork lift truck;

said flaps of the base member having upper portions extending above the load carrying means to form a shallow tray defined by the load carrying means and the upper portion of the flaps of the base member in the top of the pallet base;

a tube assembly forming an enclosed receptacle and having a bottom received in the shallow tray of the pallet base;

said tube assembly including a pair of side wall panels, a pair of end wall panels, and four bottom flanges hinged at a common scoreline on bottom edges of the respective tube wall panels;

said tube side wall panels being connected between the opposite edges of the tube end wall panels at scorelines;

said tube side wall panels further having respective reverse scorelines dividing each side wall panel into a pair of half side wall panels so that the half side wall panels can be folded between the end wall panels;

said bottom flanges being bent about the scorelines on the bottom edges of the tube wall panels to extend on top of the load carrying means substantially the full lengths of the respective tube wall panels;

said bottom flanges on the bottom edges of the tube side wall panels having the reverse scorelines extending thereacross so that the bottom flanges on the tube side wall panels can be folded with the half side wall panels;

a top cover fitting over the tube assembly, said tube assembly being such that the entire tube assembly can be fitted in the shallow tray of the pallet base when the half side wall panels and corresponding bottom flanges are folded.

8. A bulk pallet box as claimed in claim 14 wherein the supporting spacer means includes a plurality of pallet spacers, and the load carrying means includes a load platform, the pallet spacers and the load platform being received in the base member.

9. A bulk pallet box claimed in claim 7 wherein the bulk pallet box is constructed entirely from corrugated paperboard.

10. A pallet box pack as claimed in claim 14 wherein the pallet base includes a load support having a pair of load panels and support spacer panels, said load panels forming said load carrying means, said support spacer panels being folded relative to the load panels and forming said supporting spacer means, the load support being received in the base member such that the support spacer panels support the load panels in a raised position inside the base member.

11. A pallet box pack as claimed in claim 10 wherein the load panels are joined by a pair of center support spacer panels, the center support spacer panels being downfolded to provide further support for the load panels.

* * * * *

UNITED STATES PATENT OFFICE

CERTIFICATE OF CORRECTION

Patent No. 4,085,847 Dated April 25, 1978

Inventor(s) Richard P. Jacalone

It is certified that error appears in the above-identified patent and that said Letters Patent are hereby corrected as shown below:

Column 7, Line 9, delete "whch" and insert in place thereof -- which --.

Column 8, Line 29, delete "15" and insert in place thereof -- 5 --.

Column 9, Line 17, delete "14" and insert in place thereof -- 7 --.

Column 10, Line 3, after the word "box" insert the word -- as --.

Column 10, Line 6, delete "14" and insert in place thereof -- 7 --.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*